US005263310A

United States Patent [19]

Mori

[11] Patent Number: 5,263,310

[45] Date of Patent: * Nov. 23, 1993

[54] SPINNING APPARATUS

[75] Inventor: Shigeki Mori, Ohtsu, Japan

[73] Assignee: Murata Kikai Kabushiki Kaisha, Kyoto, Japan

[ * ] Notice: The portion of the term of this patent subsequent to Sep. 15, 2009 has been disclaimed.

[21] Appl. No.: 868,960

[22] Filed: Apr. 16, 1992

Related U.S. Application Data

[63] Continuation of Ser. No. 657,488, Feb. 19, 1991, Pat. No. 5,146,740.

[30] Foreign Application Priority Data

| | | | |
|---|---|---|---|
| Feb. 20, 1990 | [JP] | Japan | 2-39129 |
| Feb. 20, 1990 | [JP] | Japan | 2-39130 |
| Feb. 20, 1990 | [JP] | Japan | 2-39131 |
| Feb. 20, 1990 | [JP] | Japan | 2-39132 |

[51] Int. Cl.[5] ..... D01H 5/28; D01H 1/115

[52] U.S. Cl. ..... 57/328; 57/5; 57/333; 57/343

[58] Field of Search ..... 57/5, 332, 328, 341, 57/342, 343, 344, 350, 333

[56] References Cited

U.S. PATENT DOCUMENTS

| | | | |
|---|---|---|---|
| 3,217,482 | 11/1965 | Baer | 57/350 X |
| 4,412,413 | 11/1983 | Sakai et al. | 57/328 |
| 4,457,130 | 7/1984 | Sakai et al. | 57/328 |
| 4,497,167 | 2/1985 | Nakahara et al. | 57/328 |
| 4,827,710 | 5/1989 | Nishimura | 57/5 X |
| 4,845,932 | 7/1989 | Sakai et al. | 57/328 X |
| 4,958,487 | 9/1990 | Suganuma et al. | 57/333 X |
| 5,146,740 | 9/1992 | Mori | 57/328 |

*Primary Examiner*—Daniel P. Stodola
*Assistant Examiner*—William Stryjewski
*Attorney, Agent, or Firm*—Spensley Horn Jubas & Lubitz

[57] ABSTRACT

A spinning apparatus which imparts a turning air stream to an untwisted short fiber bundle drafted by a draft device to twist it to produce a spun yarn. A guide member supporting body having an extreme end projected conically is secured within a nozzle block for imparting a turning air stream to a fiber bundle moved out of a draft device, and the guide member supporting body having one side cut to form a gap adjacent to the nozzle block.

4 Claims, 4 Drawing Sheets

SPINNING APPARATUS

This is a continuation of application Ser. No. 07/657,488, filed on Feb. 19, 1991, now U.S. Pat. No. 5,146,740.

FIELD OF THE INVENTION

This invention relates to an apparatus which imparts a turning air stream to an untwisted short fiber bundle drafted by a draft device to twist it to produce a spun yarn.

RELATED ART STATEMENT

A conventional spinning machine is roughly classified into three types, i.e., a ring type, an open end type and an air type.

Out of them, the air type spinning machine has been developed recently, which renders possible high speed spinning several times that of the ring type spinning machine. This air type spinning machine has two air jet nozzles arranged next to the draft device (see for example, Japanese Patent Publication No. 53-45422). Each of these nozzles imparts compressed air flows which turn reversely to each other to fibers moved out of the draft device, whereby the fiber bundle is twisted by the second nozzle, the twisted fiber bundle is balooned by the first nozzle, a part of the fibers is wound on the other fiber by said baloon, and the fiber bundle further passes through the second nozzle and is untwisted whereby it is powerfully wound to produce the spun yarn.

Since this air type spinning machine produces yarns according to the twisting and untwisting type, there is a disadvantage in that the feeling of yarns to be produced is unavoidably hard and becomes poor. There are further problems in that since it is difficult for this apparatus to stabilize the behavior of the wound fibers, there is a limit in improvement in quality of yarns, and since two nozzles are used, consumption of compressed air is large, resulting in a great energy cost. Furthermore, there involves a minor difficulty in spinning ability for relatively long fibers such as wool.

In order to cope with these problems, the spinning machine mentioned below has been proposed (see Japanese Patent Laid-open No. 63-85123).

This apparatus comprises a rotating spindle having a passage through which a fiber bundle moved out of a front roller of a draft device passes, and an air jet nozzle for imparting a turning air flow to the neighborhood of an inlet of the spindle to separate an end of the fiber from the fiber bundle, the fiber end being wound around the fiber bundle.

The yarn produced by the spinning machine disclosed in the aforesaid Japanese Patent Laid-open No. 63-85123 has the nature in which the other fiber is spirally wound around the non-twisted or slightly-twisted core fiber, which is different in appearance and poor in yarn strength as compared with the ring yarn in the state where most fibers are twisted.

OBJECT AND SUMMARY

An object of an embodiment of this invention is to provide an apparatus which in such an air type spinning machine, produces yarns having the same characteristic as that of the ring yarn.

For achieving the aforesaid object one embodiment of, the present invention provides a spinning apparatus in which a guide member supporting body having an extreme end projected conically is secured within a nozzle block for imparting a turning air stream to a fiber bundle moved out of a draft device, said guide member supporting body having one side cut to form a gap adjacent to the nozzle block, and a guide member is projected on the extreme end of the guide member supporting body with the extreme end thereof directed at the center of an inlet of a spindle which rotates or stands still.

In the spinning apparatus constructed according to such an embodiment, the fiber bundle moved out of the draft device is attracted into the nozzle block from the gap, and exposed to the turning air stream in the neighborhood of the inlet of the spindle whereby the fiber bundle is slightly twisted. At that time, all fibers of the fiber bundle are positioned around the guide member and directly exposed to the air flow to receive a force to be separated from the fiber bundle but are not easily separated since the extreme end of the fiber positioned at the inlet of the spindle is subjected to twisting. The rear end of the fiber thus separated is wound about the spindle by the action of the air flow and extends outwardly. As the fiber bundle travels, the fiber is gradually drawn while turning about the fiber bundle, and most fibers are spirally wound to form a really twisted spun yarn.

DETAILED DESCRIPTION OF PREFERRED EMBODIMENT

Figure 1:
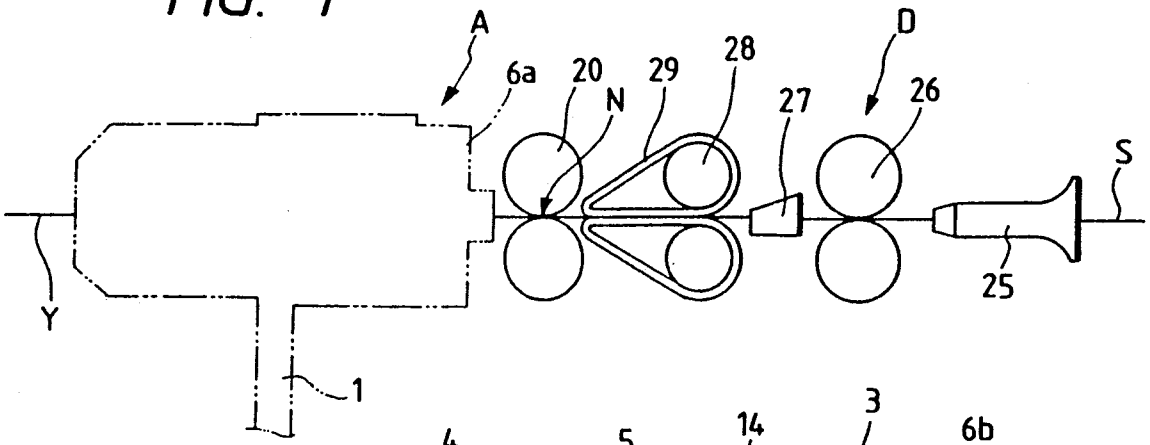
FIG. 1 is a schematic view showing an embodiment of a spinning apparatus to which is applied an apparatus of this invention.

An embodiment of the spinning apparatus according to this invention will be described with reference to the drawings.

This spinning apparatus A is arranged next to a draft device D comprising a pair of rollers 26 arranged following a sliver charging guide 25, a pair of middle rollers 28 each having an apron 29, and a pair of front rollers 20. In the drawing, a laterally extending line indicates a travel path of the fiber bundle S or the yarn Y. Reference numeral 27 designates a sliver width defining guide.

The spinning apparatus will be described in detail with reference to FIG. 2.

Reference numeral 2 designates a support plate secured to the frame, to which are secured a hollow cylindrical bearing 2, a spindle 6 and a casing 3 for a rotational body 9. This casing 3 comprises a pair of front and rear split molds, which are fixed by screws.

Interiorly of the bearing 2 is rotatably supported the spindle 6 through bearings 4 and 5, and a hollow pulley 7 is mounted in the outer periphery of the spindle 6.

Reference numeral 8 designates an endless drive belt which is in contact with the outer periphery of the pulley 7 and passed over along the unit to rotate the spindle 6 at high speed. A rotary body 9 is provided at a position forwardly of the bearing 5 of the spindle 6.

A fiber bundle passage 10 extends through the center of the spindle 6, and the center of the passage 10 and the center of the casing 3 are positioned on the same straight line coincided with the travel path of the fiber bundle S. The distance from the spindle inlet 6*a* to the nip point N of a front roller 20 is set to be shorter than an average length of fibers constituting the fiber bundle S. The outside diameter of the inlet 6*a* of the spindle 6 is sufficiently small, and the portion following the inlet 6*a* is formed into a conical portion 6*b* whose outside diameter increases toward the rotary body 9. A portion for covering the spindle 6 and the rotary body 9 of the casing 3 is designed so that the neighborhood of the inlet 6*a* of the spindle 6 serves as a small-diameter cylindrical hollow chamber 11, and a portion following the hollow chamber 11 serves as a conical hollow chamber 12 opened at a large angle.

A portion ahead of the small diameter hollow chamber 11 is formed into a cylindrical configuration having a diameter slightly larger than that of the extreme end of the spindle 6 by a nozzle block 23, said cylindrical portion serving a guide passage of the fiber bundle S. This side of the conical hollow chamber 12 is formed with an annular hollow chamber 14 and a tangential air escape hole 15 following the hollow chamber 14. An air suction pipe is connected to the air escape hole 15.

The casing 3 is interiorly formed with a hollow air reservoir 16 adjacent to the nozzle block 23. The nozzle block 23 is formed with four air jet nozzles 17 which are directed toward the inlet 6*a* of the spindle 6 from an air chamber 16 and directed tangentially of the hollow chamber 11, the air chamber 16 having an air hose 19 connected thereto through a hole 18. The direction of the nozzles 17 is set to be identical with the rotational direction of the spindle 6.

Compressed air supplied from the hose 19 flows into the air reservoir 16, after which the air jets from the nozzle 17 into the hollow chamber 11 to generate a high speed turning air flow in the vicinity of the inlet 6*a*.

This air flow turns within the hollow chamber 11 and thereafter diffuses outwardly while slowly turning within the conical hollow chamber 12. The air flow is then guided toward and discharged from the escape hole 15. At the same time, this air flow generates a suction air flow which flows into the hollow portion of the casing 3 from the nip point N of the front rollers 20.

Reference numeral 21 designates a cap fitted on the rear end of the bearing 2.

Further, a guide member supporting body 13 is secured to the inner wall of the nozzle block 23. The guide member supporting body 13 is in the form of a column having one end conically projected, and one side of the supporting body 13 is cut to form a gap 24 adjacent to the nozzle block 23, said gap 24 serving as a guide passage of the fiber bundle S. One end of the guide member supporting body 13 is conically projected as just mentioned whereby the fibers of the fiber bundle S supplied through the gap becomes hard to be wound, and even if the fiber is wound, this winding is so little that it can be easily unwound. Lengthwise of the guide member supporting body 13 is bored a hole registered with the center line of the passage 10 of the spindle 6, and a pin-like guide member 22 is inserted into the hole. The guide member 22 is projected from the hole of the guide member supporting body 13 to render the extreme end thereof free so as to front on the inlet 6*a* of the spindle 6. This guide member 22 is also effective by forming it into a conical configuration similar to the guide member supporting body 13. According to the way of installing the guide member 22, the inlet side of the apparatus is not blocked by the guide member 22, and therefore, entry of the fiber bundle S is not disturbed.

The guide member 12 is smaller in diameter than that of the passage of the inlet 6*a* of the spindle 6, and the extreme end thereof is formed into a smooth curve.

Figure 2:
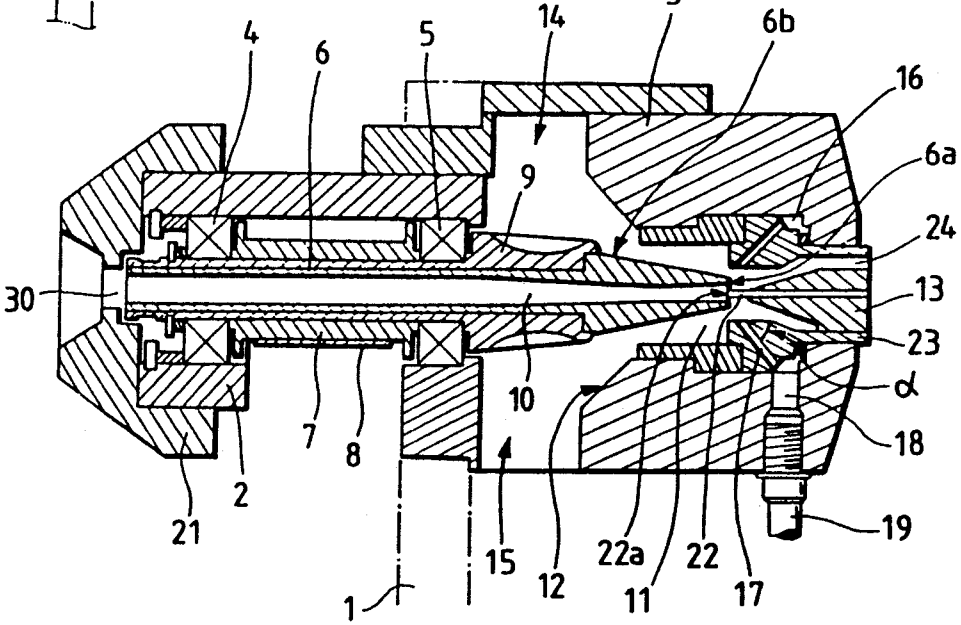
FIG. 2 is a sectional view of the apparatus according to this invention.
Figure 3:
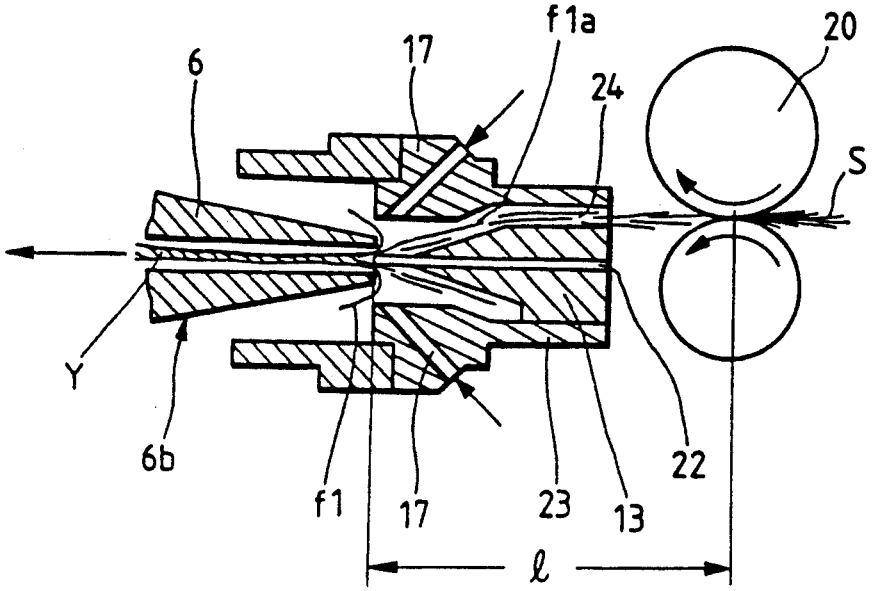
FIG. 3 is a schematic views showing the spinning state by the apparatus.

In FIGS. 2 and 3, the extreme end of the guide member 22 is in a position somewhat internally of the passage 10 from the inlet 6*a* of the spindle 6, but may assume a position away from the end of the inlet 6*a*, which can be set to an appropriate position according to the respective conditions.

The guide member 22 functions as a so-called imitation core which impedes the propagation of the twisting in the yarn forming process which will be described later or temporarily performs the function in place of the center fiber bundle, and impedes the formation of a non-twisted core fiber bundle markedly appearing in a conventional air type bundled and spun yarn to perform the function by which a yarn is actually formed merely by the wound fibers.

Next, the process for the manufacture of yarns by the apparatus for manufacturing real twist yarns A will be described.

The fiber bundle S drafted by the draft device D and fed out of the front rollers 20 is drawn into the apparatus by an air flow sucked from the gap 24 between the guide member supporting body 13 and the nozzle block 23. Prior to the delivery of the fiber bundle S from the front rollers 20, the extreme end of the suction pipe not shown is brought into contact with an outlet 30 of the cap 21 to generate an air flow sucked into the spindle 6. Accordingly, the fiber bundle S which moves through the gap 24 is smoothly sucked into the spindle 6 by the air flow.

The yarn sucked into the suction pipe through the spindle 6 is introduced into a piecing device by the movement of the suction pipe, and the yarn is pieced with a yarn on the package being introduced by a suction mouth.

The peripheral speed of the delivery rollers provided at downstream of the outlet 30 of the cap 21 is set to be slightly higher than that of the front rollers 20 so that a tension is always applied to the fiber bundle S passing through the apparatus A during the spinning.

The fiber bundle S receives the action of the compressed air which turns in the vicinity of the inlet 6*a* of the spindle 6 so that the bundle S is slightly twisted in the same direction. At that time, the fiber bundle S is impossible to be positioned within the space occupied by the guide member 22 by the presence of the guide member 22. Accordingly, all fibers f1 are positioned around the guide member 22 and directly exposed to the air flow and receive the force by which the fibers are separated from the fiber bundle S. However, when the extreme end of the fibers f1 is at a position of the inlet 6*a* of the spindle 6*a*, the extreme end is not easily separated because it is twisted. The rear end f1*a* of the fibers is not yet separated since it is nipped between the front rollers 20 as shown in FIG. 3 or it is at a position away from the nozzle 17 so that much action of air is not applied thereto.

When the rear end f1*a* of the fibers is disengaged from the front rollers 20 and moves to a position which powerfully receives the air flow from the nozzle 17, the fiber f1 is separated from the fiber bundle S. At that time, the fiber f1 is not separated since it is partly subjected to the twisting and is being inserted into the spindle 6 which is less affected by the action of air, and only the rear end f1*a* of the fiber rarely subjected to the twisting action is separated from the fiber bundle S. The rear end f1*a* of the fiber thus separated is wound once or plural times on the inlet 6*a* portion of the spindle 6 by the action of air, and then slightly wound on the conical portion 6*b* of the spindle 6, after which the rear end f1*a* is guided to the rotary body 9 and extends externally.

The fiber bundle S keeps running leftward in the figure, and on the other hand, since the spindle 6 is rotating, the fiber rear end f1*a* is gradually drawn while being turned around the fiber bundle S.

As the result, the fiber fl is spirally wound around the fiber bundle S, and the fiber bundle S is formed into a spun yarn Y which passes through the passage 10 of the fiber bundle.

In the process for the manufacture of the yarn Y, the fiber f1 is separated from everywhere in the entire outer periphery of the fiber bundle S, and the fiber positioned internally thereof is also exposed to the air flow and separated, and therefore the fiber is to be positioned in the outer periphery of the guide member 22 so that a number of fibers are continuously separated. These separated fibers are uniformly distributed to the conical portion 6*a* of the spindle 6 and the fibers to be the core are rarely present. Most fibers are twisted and wound to form real-twist yarns. The winding direction of these wound fibers f1 is determined by the direction of the nozzle 17 and the rotational direction of the spindle 6. The turning direction of the air flow caused by the nozzle 17 is preferably set to the same direction as the rotational direction of the spindle 6 so that the winding direction of the wound fiber f1 is not disturbed and the extreme end of the fiber is not separated.

As described above, according to the apparatus in the present embodiment, the twisting which tends to be propagated from the spindle 6 toward the front rollers 20 is impeded in the propagation by the guide member 22, and the fiber bundle S moved out of the front rollers 20 is not twisted by the twisting but most fibers are formed into wound fibers. This can be assured from the fact that in the case where the guide member 22 is installed, stripe-like portions in the running direction occur in the vicinity of the central portion widthwise of the rollers for fault fiber bundle delivered out of the front rollers 20.

Most preferably, the extreme end of the guide member 22 slightly moves into the passage of the spindle 6. Yarns produced in this condition have an appearance close to the ring yarns but yarns having an appearance close to the ring yarns can be produced under other conditions. These yarns are by no means inferior also in characteristic of strength to the ring yarns.

While in this embodiment, a description has been made of apparatus of the type in which twisting is applied by the spindle, it is to be noted that applications to other spinning machineries, for example, a 2-nozzle type bundle spun yarn manufacturing apparatus in which a guide member is provided on a first nozzle inlet, a spinning apparatus using nozzles and a nip type twister and a 1-nozzle type spinning apparatus can be realized according to the conditions. Furthermore, the spindle 6 assists in applying twisting to a yarn, and even if the spindle is not rotated, yarns in dependency of kinds thereof can be manufactured. Therefore, the spindle 6 need not be always rotated.

Since this invention is constructed as described above, the following effects are obtained.

That is, real-twist yarns, which are in a large amount of wound fibers and by no means inferior in both appearance and characteristic of strength to those of the ring yarns, can be produced.

Moreover, since one end of the guide member supporting body 13 is projected conically, the fibers are hard to be wound, and even if the fibers are wound, they are easily unwound. Furthermore, according to the way of installing the guide member 22, the extreme end of the guide member 22 can be accurately fronted on the center of the inlet 6*a* of the spindle 6, and since the inlet of apparatus is not blocked, entry of the fiber bundle S is not disturbed.

Figure 4:
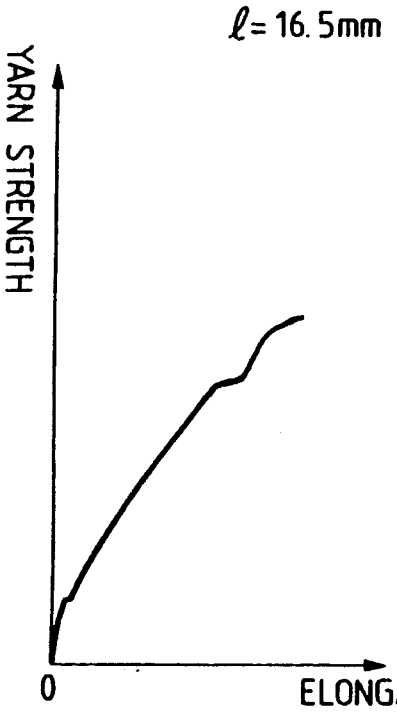
FIGS. 4 to 6 show the relationship between the strength and the elongation of spun yarns manufactured by changing the distance from the spindle inlet to the front rollers.
Figure 5:
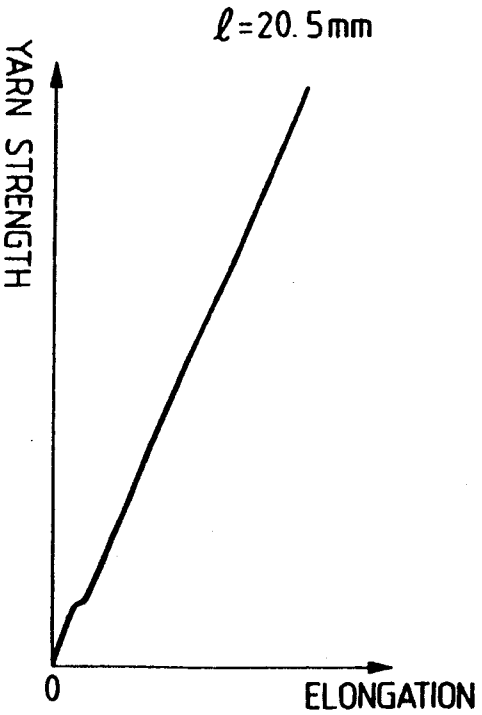
Figure 6:
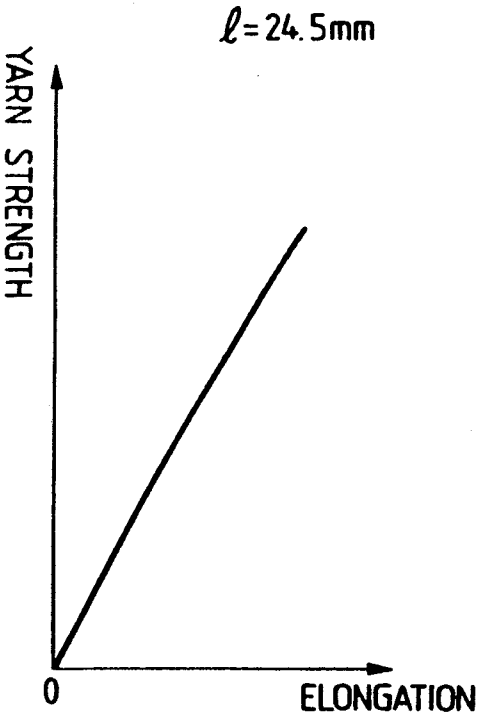

The aforementioned spinning apparatus was used to manufacture a spun yarn by supplying a cotton sliver having an average fiber length of 25 mm. The yarn was manufactured under the conditions that the length of the nozzle block 23 is 15.5 mm, the diameter is 7 mm, the nozzle diameter is 0.8 mm, and the jet air pressure is 4 kg/cm$^2$. Yarns were manufactured by changing the distance l from the spindle inlet 6*a* to the front rollers 20 to l=16.5 mm, l=20.5 mm and l=24.5 mm, respectively, to obtain the strength/elongation curve of the yarn. The results are as shown in FIGS. 4 to 6. When the length is l=20.5 mm, the yarn strength is highest to obtain a real twist yarn with less irregularity. When the length is l=16.5 mm, some part of the yarn temporarily decreases its strength as shown in FIG. 4, which is assumed to result from a displacement of fibers at a place where winding strength is small which is partly present. This yarn has many parts of bundled yarn constructions and also has a large irregularity. When the length is l=24.5 mm, a real twist yarn is obtained but the irregularity is large. After all, the optimum distance l from the spindle inlet 6*a* to the front rollers 20 is 20±3 mm. In other words, the optimum distance is of the order of 80% of the average fiber length.

That is, it is possible to manufacture real twist yarns which have an extremely large amount of wound fibers and are by no means inferior to both external appearance and strength characteristic in ring yarns.

Moreover, since the distance from the twisting portion to the front rollers is set to be slightly shorter than the average fiber length of the fiber bundle S, the irregularity of the yarns can be minimized to provide the maximum yarn strength.

Figure 7:
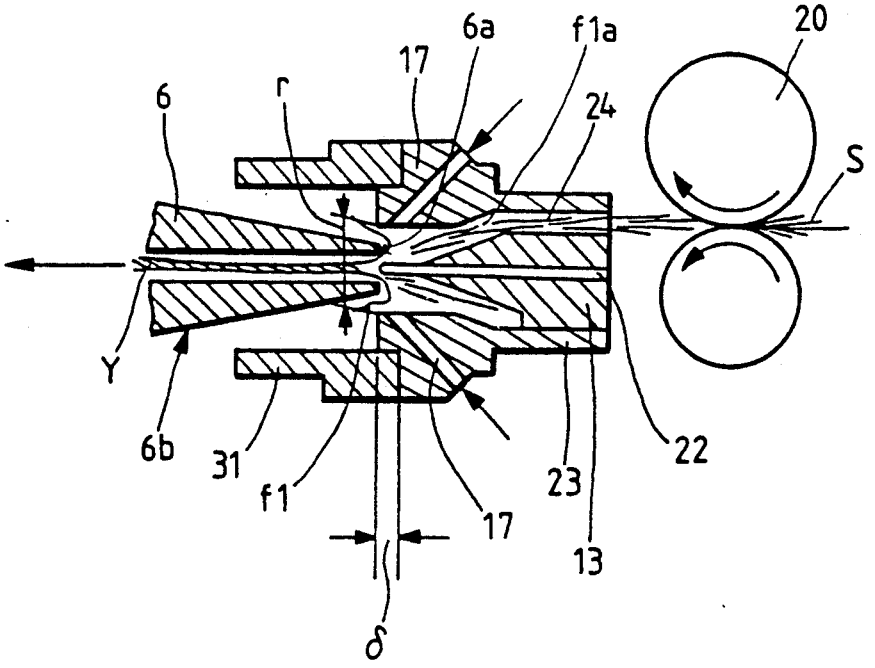
FIG. 7 is a sectional view showing a main part of a spinning apparatus.

Another embodiment of the present invention is shown in FIG. 7. A guide member 22 with an extreme end thereof fronted on an inlet 6*a* of a spindle 6 which rotates or stands still is installed within a nozzle block 23 for imparting a turning air stream to a fiber bundle S moved out of a draft device D. The inside diameter (r) of the nozzle block 23 is of the order of 4.3 mm, and the speed of the turning air stream is to be highest in the vicinity of the spindle inlet 6*a*.

The above-described spinning apparatus was used to manufacture spun yarns. The yarns were manufactured under the conditions that the cotton comber is 28 grains, the total draft of the draft device D is 82, the speed of the spindle 6 is 60800 rpm, the diameter of the nozzle 17 is 0.8 mm, the jet air pressure from the nozzle 17 is 4 kg/cm$^2$, and the yarn speed is 100/min.

Figure 8:
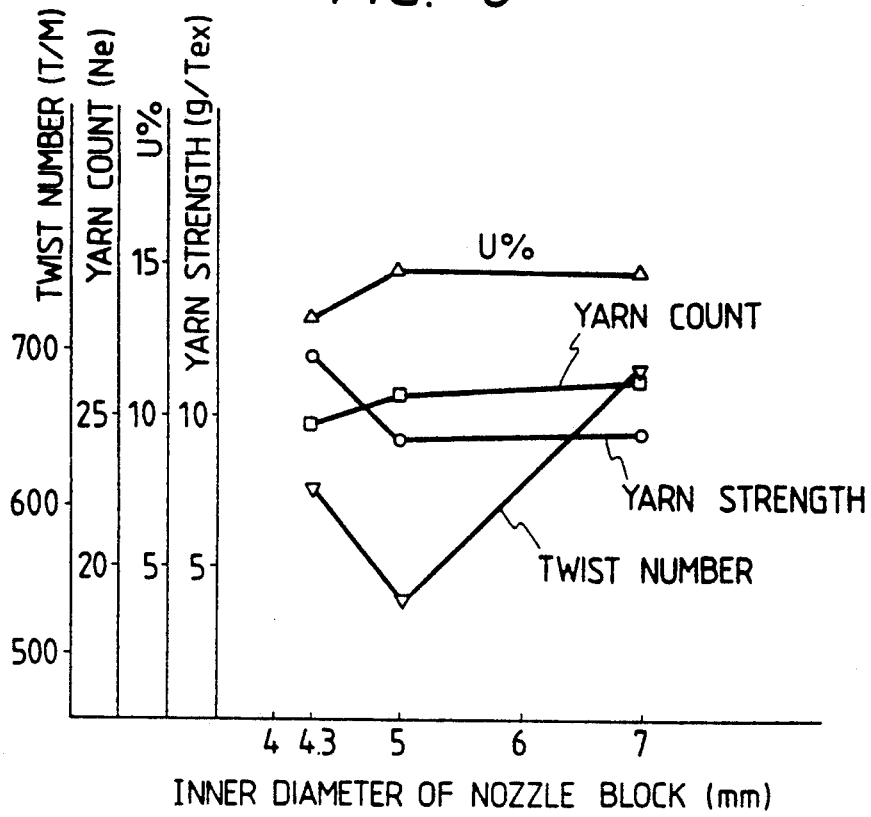
FIG. 8 shows the relationship between the inside diameter of the nozzle block and the strength, u%, count and number of twists of spun yarns manufactured.

Yarns were manufactured by changing the diameter r of the nozzle block 23 to examine the relationship between the number of twists per meter, the count Ne, the uniformity U% of yarn, and the yarn strength (g/Tex) ($\delta$ later described is $-0.5$). The results are shown in FIG. 8. According to this, in the vicinity of r=4.3 mm, the yarn strength is high and the U% is low, which are satisfactory. When the r is less than said value, a gap between the nozzle block 23 and the spindle 6 is so narrow that yarns cannot be manufactured unless an jet air pressure is dropped. If the jet air pressure of the nozzle 17 is lowered to a level less than 3 kg/cm$^2$, yarns can be manufactured but the strength thereof is extremely low.

Figure 9:
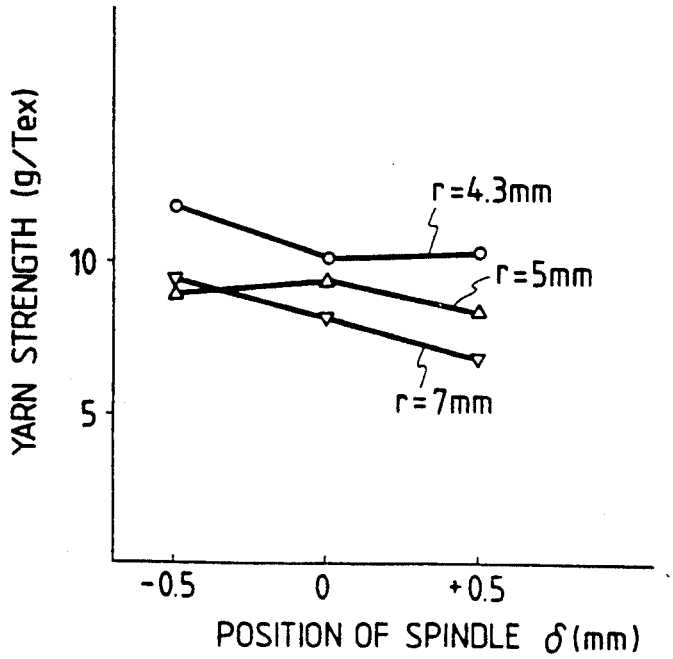
FIG. 9 shows the relationship between the spindle position and the strength of spun yarns to be manufactured.

In FIG. 7, yarns were manufactured by variously changing (as below) the distance $\delta$ from the spindle inlet 6*a* to the end on the inlet side of the bush 31 (plus in the case where the spindle inlet 6*a* is this side in the moving direction of the fiber bundle from the end at the inlet side of the bush 31, and minus in the case reverse thereto) to examine the yarn strength. The results are as shown in FIG. 9. It is understood that the highest yarn strength is obtained when $\delta=0.5$ mm. The highest speed of the turning air stream is obtained at that position.

In the above-described spinning apparatus shown in FIG. 2, yarns were manufactured by variously changing an angle of inclination $\alpha$ of the nozzle 17 with respect to the moving direction of the fiber bundle S in the range of 45° to 90°. In this case, however, a jet air stream is always blown out in the vicinity of the inlet of the spindle 6 even if the angle of inclination $\alpha$ of the nozzle 17 is changed. The diameter of the nozzle is 0.8 mm, and the jet air pressure from the nozzle 17 is 4 kg/cm$^2$.

It is found from the result that the angle of winding fibers of the yarn to be manufacture increases as the angle of inclination o of the nozzle 17 increases. That is, the number of twists of the yarn increases. In order to obtain the yarn having the number of twists that is satisfactory, the angle of inclination $\alpha$ of the nozzle was 70 to 90°.

In order to obtain the same number of twists, as the angle of inclination $\alpha$ increases, the amount of jet air of the nozzle 17 can be decreased. If several nozzles 17 different in the angle of inclination $\alpha$ are prepared, the number of twists suitable for the intended yarn can be obtained.

What is claimed is:

1. A spinning apparatus for spinning a fiber bundle provided by a draft device, comprising:

a rotatable spindle defining an axis and an inlet, a nozzle block including a nozzle for imparting a turning air stream to the fiber bundle, and a guide member defining an axis and arranged substantially coaxially with the inlet of the rotatable spindle, the guide member being disposed within the nozzle block, wherein an angle of inclination of the nozzle with respect to a moving direction of the fiber bundle is substantially equal to between approximately 70° and 90°.

2. A spinning apparatus as claimed in claim 1, wherein the draft device includes a pair of front rollers, a distance l from the rotatable spindle inlet to the front rollers being set to be less than an average length of the fiber bundle.

3. A spinning apparatus for spinning a fiber bundle provided by a draft device, comprising:

a rotatable spindle defining an axis and an inlet, a nozzle block for providing a turning air stream to the fiber bundle, the air stream having a speed, and a guide member defining an axis, the guide member disposed within the nozzle block and arranged substantially coaxially with the inlet of the spindle, wherein an inside diameter of the nozzle block is approximately equal to 4.3 mm, and the speed of the turning air stream is set to be highest in the vicinity of the inlet of the rotatable spindle.

4. A spinning apparatus as claimed in claim 3, wherein the draft device includes a pair of front rollers, a distance l from the rotatable spindle inlet to the front rollers being set to be less than an average length of the fiber bundle.

* * * * *